United States Patent [19]

Alcock et al.

[11] Patent Number: 4,947,665

[45] Date of Patent: Aug. 14, 1990

[54] APPARATUS FOR THE ELECTRICAL CONTROL OF AN IN-LINE DRAWING MACHINE

[75] Inventors: Richard A. Alcock; Scott A. Alcock, both of Roscoe; Michael J. Yankaitis, Rockford, all of Ill.

[73] Assignee: Rockford Manufacturing Group, Inc., Roscoe, Ill.

[21] Appl. No.: 327,522

[22] Filed: Mar. 23, 1989

[51] Int. Cl.[5] ..... B21C 1/12

[52] U.S. Cl. ..... 72/17; 72/289; 250/211 K; 250/237 G

[58] Field of Search ..... 72/289, 288, 279, 280, 72/14, 17; 250/211 K, 237 G

[56] References Cited

U.S. PATENT DOCUMENTS

| | | | |
|---|---|---|---|
| 2,321,612 | 6/1943 | Nye | 72/279 |
| 3,280,611 | 10/1966 | Lathom et al. | 72/289 |
| 3,402,588 | 9/1966 | Guthrie | 72/289 |
| 3,539,816 | 11/1970 | Chamberlin | 250/211 K |
| 3,646,798 | 3/1972 | Alcock | 72/288 |
| 3,709,021 | 1/1973 | Jackman | 72/289 |
| 4,045,992 | 9/1977 | Griffiths | 72/289 |
| 4,079,609 | 3/1978 | Hodgekiss | 72/289 |
| 4,099,403 | 7/1978 | Alcock et al. | 72/289 |
| 4,523,090 | 6/1985 | Wagner | 250/211 K |
| 4,554,451 | 11/1985 | Kirstein | 250/237 G |

OTHER PUBLICATIONS

Silicon Sensors, Inc., Dodgeville, Wisc., Technical Bulletin SS 1600, 1610, (no date).

Rexnord, Milwaukee, Wisc., "Duralon Composite Bearings, Smooth, Accurate, Durable", 1987.

*Primary Examiner*—Daniel C. Crane

*Attorney, Agent, or Firm*—Leydig, Voit & Mayer

[57] ABSTRACT

An apparatus is disclosed for drawing a length of wire through a die and for supplying the wire to a using station wherein the apparatus utilizes a mechanical variable-speed drive mechanism and a sensing arm for sensing the error between the consumption and feeding rates of the wire and integrating the same. An electromechanical apparatus couples the sensing arm to the variable-speed drive so that the full range of drive ratios of the variable-speed mechanical drive mechanism can be utilized without the occurrence of a pull-back force at the wire. The mechanical pivoting of the sensing arm is translated to an electrical signal by way of the electromechanical apparatus which incorporates a plunger for oscillatory motion in response to the pivoting of the compensator arm. An electrical device is sensitive to the displacement of the plunger in a manner to provide a signal having a linear relationship to the magnitude of the displacement by the plunger caused by its oscillatory movement. The electrical device is not in direct physical contact with the plunger, thereby providing a friction free transition of mechanical movement of the plunger to an electrical signal.

10 Claims, 4 Drawing Sheets

APPARATUS FOR THE ELECTRICAL CONTROL OF AN IN-LINE DRAWING MACHINE

TECHNICAL FIELD

This invention relates to an in-line wire drawing machine of the type which pulls a length of wire through a drawing die and supplies the wiring to a using station where a production machine such as a cold header performs an operation on the wire. More particularly, the invention relates to a wire drawing machine of the same general type as disclosed in U.S. Pat. No. 4,099,403 to Alcock et al., U.S. Pat. No. 3,646,798 to Alcock, U.S. Pat. No. 3,280,611 to Lathom et al. and U.S. Pat. No. 3,402,588 to Guthrie.

BACKGROUND OF THE INVENTION

In wire drawing machines of the foregoing type, a coil of wire is wrapped around a rotatable drum. When the drum is rotated, wire is drawn through a die and wound onto one end of the drum and, at the same time, wire is unwrapped from the other end of the drum and is delivered to the production machine. The speed of rotation of the drum must be matched to the demand of the production machine and, for this purpose, the drum is rotated by a variable-speed drive mechanism which may be adjusted manually to cause the drum to rotate at a selected speed. To adjust the speed of the drum in response to changes in the rate of wire consumption by the production machine, a pivoted compensator arm is biased into engagement to a loop of wire formed after the wire leaves the drum. When the speed of the drum is too great, the size of the loop increases and the arm swings in one direction to either shut off or slow down the drive to the drum. If there is insufficient supply of wire, the loop decreases in size and causes the arm to swing in the opposite direction so as to either restart the drive or increase its speed.

In those instances where the variable-speed drive mechanism is of the mechanical type, the adjustment of the speed of the drum can only be made over a portion of the speed range of the drum. The operator of the machine typically begins operation by adjusting a hand crank so as to cause the mechanical variable-speed drive mechanism to rotate the drum at a speed at which the drum supplies just slightly more wire than is being consumed by the using station. As a result, the loop tends to increase in size and permits biasing springs to pivot the compensator arm clockwise. Such clockwise pivoting of the compensator arm is mechanically linked to a commercially available variable-speed mechanical drive mechanism. In response to the pivoting of the compensator arm, the mechanical linkage changes the effective diameter of one of the pulleys in the drive mechanism so as to change the drive ratio between an electric drive motor and the drum.

A variable-speed drive mechanism of the foregoing type is typically mounted on the frame of the in-line drawing machine. The adjustable-diameter pulley is directly driven by the electric drive motor and is connected by an endless belt to a similar adjustable pulley mounted on a shaft which serves to drive a speed reducer. The output shaft of the speed reducer is connected to the drive shaft of the drum by a second endless belt and by additional pulleys.

A significant problem with the conventional variable-speed drive mechanism is that tension or a "pull-back" force is developed on the wire as the linkage joining the compensator arm of the drive mechanism attempts to change the effective diameter of the pulleys. Specifically, as the diameter of the top pulley in the variable-speed mechanical drive is made larger, an axially slidable disc of the bottom pulley is pressed into a biasing spring. The force of the spring is fed back to the compensator arm such that a "pull-back" force is exerted on the wire, thereby creating tension along the length of the wire as it is supplied to the using station. Such tension is highly undesirable since it may result in the wire pulling away from the using station and causing the production machine to be severely damaged. For example, the dies used in cold headers can be ruined if a stamping operation occurs without wire correctly positioned between the halves of the die. Too much tension in the wire may cause the end of the wire to pull away from its proper position in the die—hence, the name "pull-back" force.

In order to avoid tension in the wire and the associated risk of damaging the production machine fed by an in-line wire drawing machine, the previously mentioned '403 patent to Alcock employs a mechanism for limiting the speed adjustment of the drum to a range centered about the nominal consumption rate of the production machine. By providing for a limited speed adjustment, the demand by the linkage for changes in the effective diameter of the pulley is limited, thereby also limiting the magnitude of the "pull-back" force exerted on the wire.

Limited speed adjustment may avoid placing too much tension on the wire, but it requires constant monitoring for the possible need of manual adjustment of the initial set up of the wire drawing machine, and such monitoring and manual adjustment is undesirable. In this regard, these machines are often manned by a relatively unskilled work force, and the availability of only a limited speed adjustment requires that these machines be carefully watched in case a speed adjustment outside of the range of an automatic adjustment becomes necessary. In such a case, the nominal speed of the machine must be adjusted by hand in order to ensure the required connection remains within a predetermined range of the nominal value.

SUMMARY OF THE INVENTION

One of the important objects of the present invention is to provide a new and improved wire drawing machine having a variable-speed drive which is of a comparatively simple and inexpensive type and which is adapted to be automatically adjusted to trim the speed of the drum without requiring a nominal initial speed setting and occasional subsequent adjustment thereof. In this connection, it is also an important object of the present invention to provide automatic adjustment of the speed of the drum over its full range of possible speeds without introducing significant tension into the wire supplied to the using station.

Another important object of the present invention is to provide a mechanism for controlling the rate of supplying wire to a using station such that the rate of supply is immune to short-term transient changes in the rate of consumption by the production machine of the using station.

Another important object is to provide a simple and low-cost mechanism for controlling the speed of the drum of the in-line drawing machine over its full range of possible speeds for many hours of continuous running without requiring maintenance.

These and other objects and advantages of the invention will become more apparent from the following detailed description when take in conjunction with the accompanying drawings.

Briefly, the in-line drawing machine of the invention incorporates a unique mechanism for converting mechanical motion to electrical signals in a manner that provides for the mechanical decoupling of the compensator arm and the variable-speed drive, thereby eliminating a "pull-back" force or tension on the wire resulting from speed adjustments. By eliminating the problem of "pull-back" forces, the machine can be dynamically adjusted over the full range of drive ratios available from the variable-speed drive mechanism instead of limiting the available range about a nominal drive ratio as in prior machines. The mechanism for converting mechanical motion to electrical signals includes a plunger mounted for oscillatory movement in response to the pivoting of the compensator arm of the drawing machine. An electrical device is provided which is sensitive to the oscillatory movement of the plunger to produce a signal which has a linear relationship with respect to the displacement of the plunger. The signal is provided to a control circuit and associated servomotor for adjusting the drive ratio of the variable-speed drive when the error between the rates of wire feeding and consumption accumulates or sums to a predetermined amount. The electrical device and plunger are not in direct physical contact so no frictional wearing occurs at the point of transition from mechanical motion to electrical signal.

DETAILED DESCRIPTION OF THE PREFERRED EMBODIMENT

Figure 1:
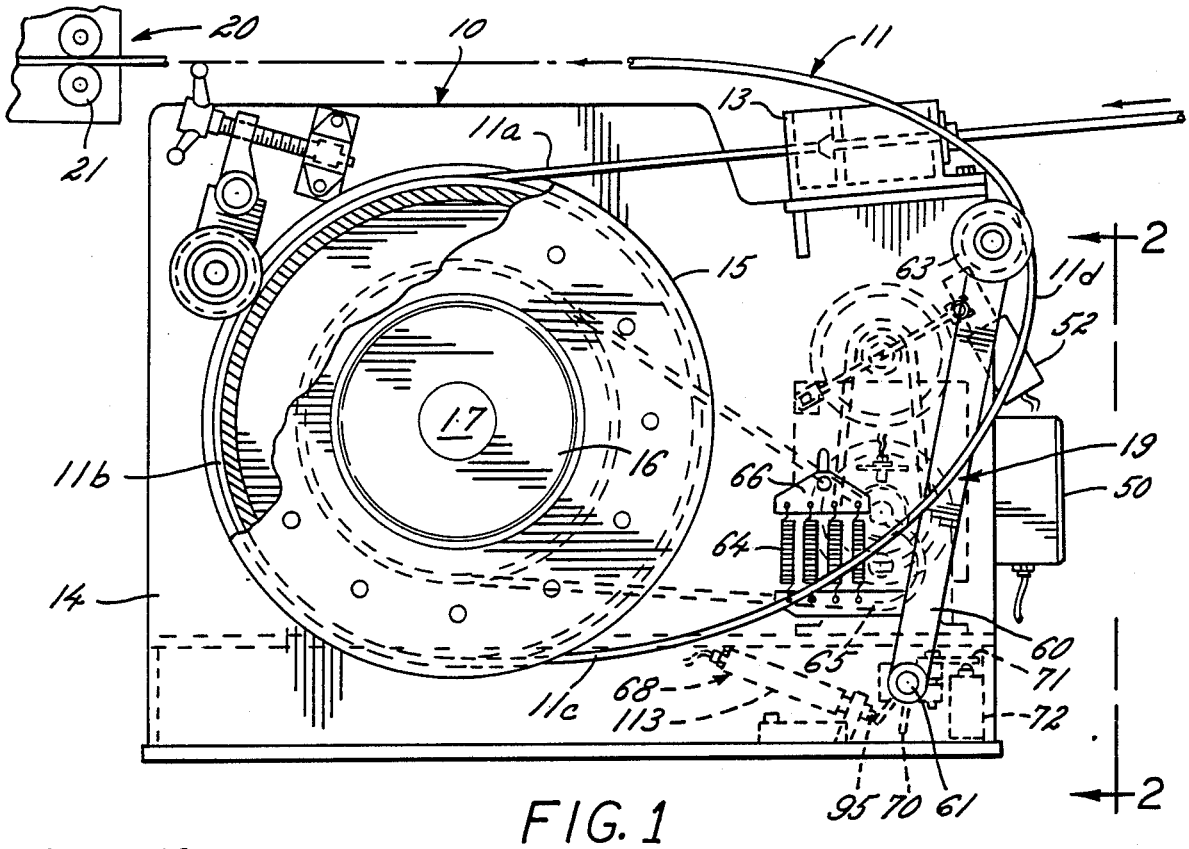
FIG. 1 is a side elevation view of a new and improved wire drawing machine incorporating the unique features of the present invention, parts of the machine being broken away and shown in sections.

As shown in the drawings for purposes of illustration, the invention is embodied in a machine 10 for pulling a length of wire 11 through a drawing die 13 which serves to reduce the diameter of the wire. The drawing die is secured to the main support or frame of the machine, the frame being indicated generally by the reference numeral 14.

To pull the wire 11 through die 13, the machine 10 includes a capstan or drum 15 secured to a torque hub 16 and adapted to be rotated about a horizontal axes defined by the axis of a shaft 17 whose ends project outwardly from the hub and are suitably journaled by the frame 14. When the drum 15 is rotated, an entering length of wire 11*a* is pulled onto one end portion of the drum (hereinafter the entrance end portion) and the wire is wound in a coil 11*b* around the drum, the coil being composed of a number of wraps in a single layer. At the other end portion of the drum (hereinafter the exit end portion), an exiting length of wire 11*c* is uncoiled from the drum and is formed into a loop 11*d* by a sensing or compensating arm 19 whose structure and function will be described subsequently. After looping around the compensating arm, the wire is supplied to a using station 20 where apparatus such as further drawing die, a wire straightener, a wire winding machine, a cold header or other production machine may be located. In the present instance, it may be assumed that a cold header is located in the using station 20 and that the wire 11 is drawn off of the drum and supplied to the cold header by a pair of intermittently rotatable feed rolls 21.

The compensating arm 19 comprises an elongated upright member 60 whose lower end is secured rigidly to one end portion of a horizontal shaft 61 which is journaled by the frame 14. A grooved wheel 63 is supported rotatably on the upper end portion of the member 60 and engages the loop 11*d* in the wire. The arm 19 is biased to swing in a clockwise direction (FIG. 1) and thus the wheel 63 tends to increase the size of the loop 11*d*. For this purpose, several contractile springs 64 are stretched between a projection 65 on the lower end portion of the member 60 and a plate 66 which is secured to the frame 14, the plate being adjustable in a vertical direction so as to enable the spring tension to be changed. Thus, the springs 64 urge the arm in a clockwise direction in order that the arm may take up the slack in the loop 11*d*.

If the loop 11*d* becomes excessively large, the arm 19 pivots to an extreme clockwise position and, in so pivoting, rocks the shaft 61 clockwise to cause a dog 71 (FIG. 1) on the shaft to engage and open a limit switch 72. Opening of the switch 72 dienergizes the drive motor 24 and stops drum 15 from rotating so that the cold header can consume the excess wire and reduce the size of the loop 11*d*. As the loop decreases in size, it pivots the arm 19 in a counterclockwise direction against the bias of the springs 64 and, as the arm pivots, the dog 71 moves away from the limit switch 72 to re-start the motor and re-initiate rotation of the drum 15. Accordingly, the arm stops the drum when the loop becomes too large and thus prevents the wire from slipping on and galling the drum.

The drum 15 is rotated by a variable-speed mechanical drive mechanism 23 which preferably, but not necessarily, is of the commercially available type such as that sold under the trademark U.S. Varidrive by Emerson Electric Company of Milford, Conn. Such a drive mechanism is mounted on the frame 14 and includes an electric motor 24 (FIG. 2) having a drive shaft 25 which supports a pulley 26 whose effective diameter may be adjusted. The pulley 26 is connected by an endless belt 27 to a similar adjustable pulley 29 mounted on a shaft 30 which serves to drive a speed reducer or fixed transmission 31. The output shaft 34 of the speed reducer is connected by an endless belt 35 and by pulleys 36 and 37 to the shaft 17 of the drum 15.

Figure 2:
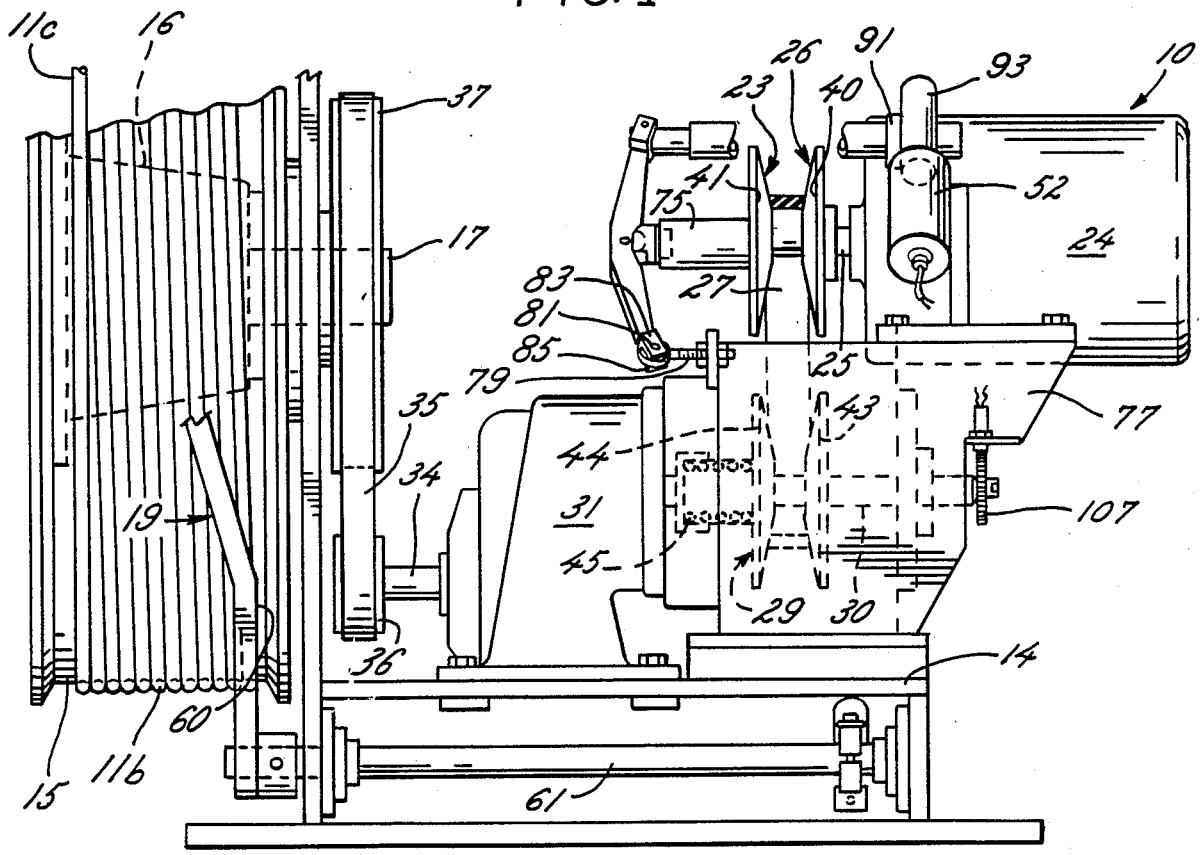
FIG. 2 is an enlarged view taken substantially along the line 2—2 of FIG. 1 and showing certain parts of the machine in section.

As shown in FIG. 2, the pulley 26 includes an axially fixed disc 40 and further includes a second disc 41 which is mounted slidably on the shaft 25 so as to slide toward and away from the disc 40. Similarly, the pulley 29 includes an axially fixed disc 43 and an axially slidable disc 44, the slidable disc being biased toward the fixed disc by a coil spring 45 which is telescoped over the shaft 30.

In setting up the machine 10, the operator typically first coils the wire about the drum 15. In this regard, a "jog" speed is initiated at the drum 15 so as to rapidly coil the wire 11 about the drum. When the coil has been completed, the "jog" speed is terminated causing the drive system to default to a normal running condition. With the end of the wire 11 wrapped about the compensating arm 19, the operator pulls the leading end of the wire toward the using station 20 in order to feed it between the rollers 21. As the operator pulls the wire 11, the loop **11*d* becomes smaller, causing the compensating arm 19 to pivot in a counterclockwise direction as viewed in FIG. 1. Such counterclockwise pivoting of the compensating arm 19 causes the drum 15 to increase its rotational speed in order to reduce the tension in the loop 11*d*** as will be explained more fully hereinafter.

Once the wire 11 has been fed into the rollers 21, the in-line drawing machine 10 automatically compensates the rate at which it supplies wire 11 so as to match any variations in the rate of consumption of the wire by the using machine 20. Specifically, the compensating arm 19 senses a difference between the rate at which the wire is being delivered from the drum and the rate at which the wire is being consumed by the cold header and, if such difference is not a short-term transient, a servomotor 52 is energized, causing the disc 41 of the pulley 26 to slide along the shaft 25 toward or away from the disc 40, thereby effecting a change in the rate of wire supply by changing the drive ratio coupling the drive shaft 17 of the drum 15 to the electric motor 24.

In accordance with one aspect of the present invention, the comparatively simple and inexpensive variable-speed drive mechanism is equipped with a unique speed trim control which serves to automatically adjust the rotational speed of the drum 15 in accordance with the demands of the using station 20. By virtue of the speed trim control, the drum is rotated on a substantially continuous basis and need not require manual adjustment when the rate of wire falls outside of a range centered about a nominal rate of wire supply. Thus, intermittent adjustments of a nominal rate of supply are not necessary in order to maintain an actual rate of supply which matches the consumption rate of the cold header of the using station 20. In fact, a nominal rate of supply need not be defined since the variable speed mechanical drive is automatically adjusted over its full dynamic range. Moreover, the electromechanical nature of the automatic speed trim control serves to decouple the force generated by the servomotor 52 as it slidably moves the disc 41 along the shaft 25 in order to change the drive ratio between the shaft 17 of the drum 15 and the electric motor 24. Thus, a comparatively low exiting tension is maintained in the wire loop **11*d* supplied from the drum 15**, regardless of the extent of adjustment required by the variable speed mechanical drive.

More specifically, the automatic speed trim control responds to pivoting of the compensating arm 19 and serves to adjust the position of the disc 41 of the pulley 26. In the preferred embodiment illustrated herein, a shifting lever 73 is mounted to a pedestal 75 extending from a base of the disc 41 and surrounding the shaft 25. One end of the lever 73 is fixed to a housing 77 for the pulley 29 so as to provide a fulcrum. An eyelet head of a bolt 79 threaded to the housing 77 receives a pin 81 spanning two flange portions 83 and 85 extending from a first end of the lever 73. The pin 81 and bolt cooperate to allow pivoting of the end of the lever 73 about the axis of the pin. An elongated ball screw 87 extends from the second end of the shifting lever 73. Telescoping slidably over the ball screw 87 is a tube 89 having one of its ends disposed in engagement with a ball nut 91 threaded on the screw and carrying a sprocket (not shown). A worm gear 93 is threaded to the sprocket and driven by the servomotor 52 which is mounted to the housing of the electric motor 24.

Figure 3:
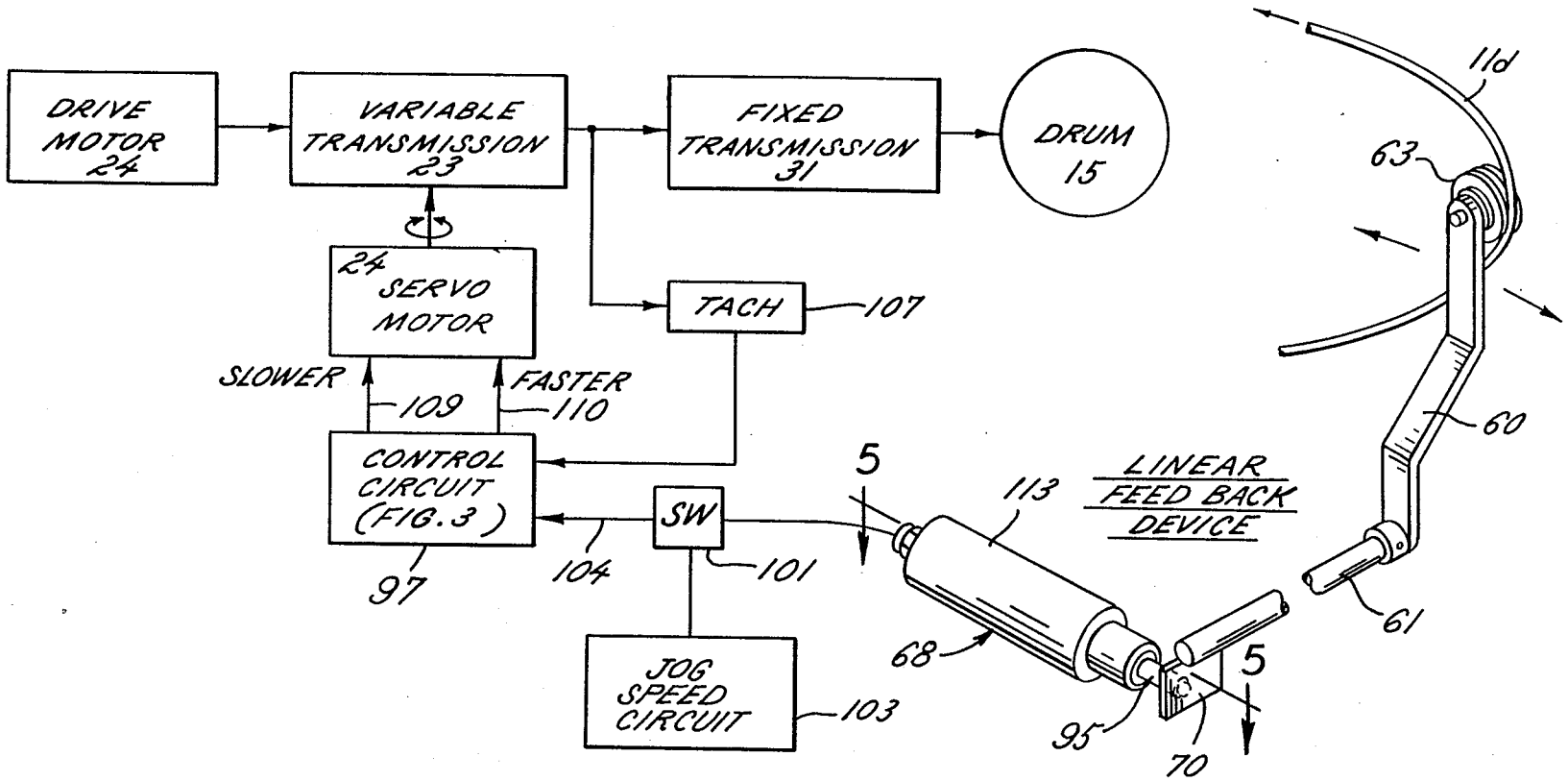
FIG. 3 is a diagram illustrating on electromechanical feedback apparatus used to realize the invention in accordance with a preferred embodiment.

To explain the operation of the automatic speed trim control of the invention, let it be assumed that the drive mechanism is rotating the drum 15 at a speed which supplies just slightly more wire 11 than consumed by the cold header at the using station 20. As a result of the over supply of wire 11, the loop **11*d* tends to increase in size and permits the springs 64 to pivot the compensating arm 19 clockwise, such pivoting resulting in clockwise turning of the shaft 61. Referring to FIGS. 1 and 3, as the shaft 61 turns, the dog 70 moves a plunger 95 of an electromechanical feedback apparatus 68 which converts the mechanical position of the arm 19 into an electrical signal. In the preferred embodiment, slidable movement of the plunger 95 effects a change of resistance in a control circuit 97. It will be appreciated, however, that the electromechanical feedback apparatus 68 may cause changes to other types of electrical characteristics in order to reflect changes in the position of the arm 19. Because the feedback system is linear, however, changes in the chosen electrical characteristic must have a linear relationship with changes in the position of the arm 19**.

Left uncorrected, the differential between the rates of supply and consumption of the wire 11 causes the loop **11*d* to continue increasing in size. As the arm 19 and the associated shaft 61 continue to turn, the electrical signal from the electromechanical feedback apparatus 68 reaches a value outside of a predetermined range set in the control circuit 97. When such a condition is sensed by the control circuit 97, a command signal is given to the servomotor 52 to drive the worm gear 93 in a clockwise or counterclockwise direction so as to move the elongated ball screw 82 in or out of the tube 89, thereby sliding the disc 41 on the shaft 25 toward or away from the disc 40 of the pulley 26. By changing the distance separating the discs 40 and 41, the effective diameter of the pulley 26 is changed and the drive ratio between the electric motor 24 and the drive shaft 17 of the drum 15 is affected. The servomotor 52 continues to turn the worm gear 91 so as to effect a change of speed of the drum 15 until the signal from the electromechanical feedback apparatus 68 returns to a level within the predetermined range. When the electrical signal from electromechanical feedback apparatus 68 has returned to a value within the predetermined range, the servomotor 52 is stopped and the transmission between the drive motor 24 and the drum 15** is fixed until the electrical feedback signal again varies outside of the predetermined range.

The electromechanical feedback can be of disadvantage, however, if the arm 19 oscillates at a relatively high frequency, thereby creating signals from the electromechanical feedback apparatus 68 which require response characteristics of the variable-speed transmission which simply are impractical. If high frequency oscillations of the arm 19 (i.e., short-term transients in rate of wire consumption) are fed back by the electromechanical feedback apparatus 68, an unstable condition results.

In keeping with the invention, in order to avoid an unstable condition, the control circuit 97 includes a low-pass filter 99 (FIG. 4) which removes components of the electrical control signal having response demands outside of the abilities of the mechanical variable-speed transmission 23. These components are removed before the control signal is determined to be within or outside of the predetermined range of values. In this manner, the control circuit 97 and the servomotor 52 are isolated from transient supply or consumption rates that may produce electrical signals which fall outside of the predetermined range setting in the control circuit 97 nut which are characterized by such a short time duration that the variable-speed transmission 23 is unable to respond quickly enough. Stated more simply, the low-pass filter 99 damps the response characteristics of the control circuit 97 in order to match them to those of the mechanical devices so that the command signals to the servomotor 52 do not attempt mechanical adjustments of the variable-speed transmission 23 at a rate greater than the response rate of the transmission.

Figure 4:
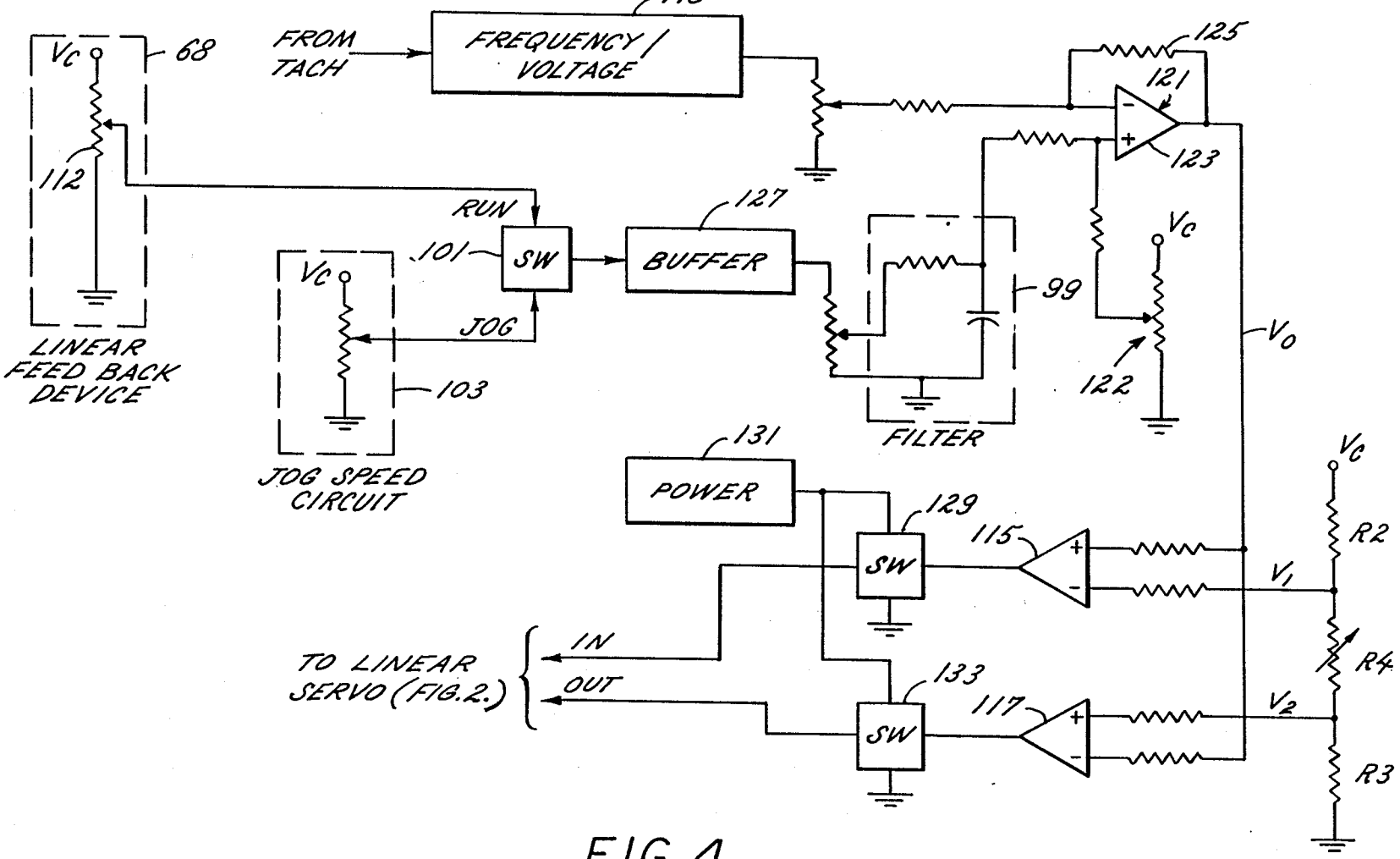
FIG. 4 is a block diagram of a control circuit according to the preferred embodiment of FIG. 3.

Referring now to FIGS. 3 and 4, a manually operated switch 101 overrides the signal from the electromechanical feedback apparatus 68 in order to command the rotation of the drum 15 at a "jog" speed by way of a conventional "jog" speed circuit 103. After the wire has been coiled on the capstan or drum 15, the switch 101 is released and the machine 10 reverts to a normal run condition which includes the electromechanical feedback apparatus 68.

The control circuit 97 receives a command signal 104 from either the "jog" speed circuit 103 or the electromechanical feedback apparatus 68, depending upon the condition of the switch 101. A reference input signal 105 to the control circuit 97 is derived from a tachometer 107 (FIGS. 2 and 3) which is driven by the shaft 30 of the pulley 29 (see FIG. 2). From the two signal inputs 104 and 105 indicating an actual speed and a commanded speed, the control circuit 97 provides control signal outputs 109 and 110 to the servomotor 52 which serve to rotate the output shaft 111 of the motor in a clockwise or counterclockwise direction. Depending upon the directional movement of the servomotor 52, the shift lever 73 (FIG. 2) moves the disk 41 of the pulley 26 away from or toward the opposing disk 40 of the same pulley, thereby causing a change in the drive ratio between the drive motor 24 and the drum 15.

In order to translate the mechanical motion of the arm 19 into electrical signals, the electromechanical feedback apparatus 68 employs a photoresistor 112 whose value is dependent upon the position of the plunger 95 within a cylindrical housing 113. The plunger 95 is biased against the dog 70 attached to the pivot shaft 61 of the arm 19. As the shaft 61 pivots in response to tension in the loop **11*d*, the dog 70 moves the plunger relative to the cylinder 113. As explained more fully hereinafter, such relative motion of the cylinder 113 and plunger 95 causes a change in the photoresistance of the apparatus 68, thereby changing the amplitude of the command signal 104 delivered to the control circuit 97. The control circuit 97, servomotor 52 and variable transmission 23 respond to the command signal 104 from the photoresistor to change the speed of the drum 15 if the difference between the command signal and the signal 105 from the tachometer 107** differs by more than a predetermined amount.

The compensator arm 19 acts as an integrator of the error between the rates of feeding and consuming the wire 11. If an error persists between these rates, the compensator arm 19 pivots clockwise or counterclockwise as previously described until the accumulated error causes the electromechanical feedback apparatus 68 to output a voltage $V_0$ to the operational amplifies 115 and 117 which is greater than $V_1$ or less than $V_2$; where the range of voltage $V_1$ to $V_2$ is the previously mentioned predetermined range. When $V_0$ falls outside the voltage range $V_1$ to $V_2$, the servomotor 52 is activated in order to adjust the drive ratio from the motor 24 to the drum 15 in a manner which attempts to match the consumption and feed rates of the wire 11.

The voltage range $V_1$ to $V_2$ defines the sensitivity of the control circuit 97 to accumulated error. So long as the accumulated error of the rates of feeding and consuming is maintained within a range which effects a voltage $V_0$ within the range $V_2$ to $V_1$, no speed adjustment is deemed necessary.

Short-term transient errors between the rates of feeding and consuming the wire 11 may be sufficiently large to cause the voltage $V_0$ to exceed $V_1$ or drop below $V_2$, resulting in the servomotor 52 and variable transmission 23 attempting a speed adjustment. As previously mentioned, applicants have found that such short-term transient errors require response times that cannot be accommodated by the servomotor 52 and the variable transmission 23. The low-pass filter 99 removes short-term transient signals from the signal of the electromechanical apparatus 68. By adding the filter 99 in the control circuit 97 of FIG. 4, the control circuit is effectively damped to match the response characteristics of the servomotor 54 and the variable transmission 23.

Within the control circuit 97, a frequency-to-voltage converter 119 transforms the frequency signals from the tachometer 107 to a dc voltage which is fed to an error circuit 121 configured from an operational amplifier 123 and utilizing a negative-feedback network 125 in a conventional manner. In order to maintain proper operation of the variable transmission 23, a constant voltage $V_c$ is provided by a voltage divider network 122 at the positive input of the operational amplifier 123 which maintains a minimum speed of the drum 15. Specifically, if the voltage at the positive input of the operational amplifier was allowed to fall below $V_c$, the control circuit 97 may activate the servomotor 54 and attempt to provide a drive ratio at the variable transmission 23 that is mechanically out of range, given a constant speed of the motor 24. The variable resistance of the photoresistor 112 is modeled in FIG. 4 as a resistance connected to a source $V_o$ and ground, with the voltage from an adjustable wiper fed to the positive input of the operational amplifier 123 of the error circuit 121 by way of the switch 101, a conventional buffer circuit 127 and the filter 99.

The error signal $V_0$ from the error circuit 121 is delivered to the pair of comparitors 115 and 117, each configured from an operational amplifier in a conventional manner. A voltage divider network composed of resistances R2, R3 and R4 variable resistance provides reference voltages $V_1$ and $V_2$ into the second inputs of the comparitors 115 and 117 so as to define a range of values for the error signal $V_0$ within which the error resulting from a difference in wire feed and consumption rate is considered acceptable. When the error signal $V_0$ exceeds the reference value $V_1$, the comparitor 115 activates a switch 129 which delivers a power source 131 to the servomotor 52, causing the servomotor to rotate in either a clockwise or counterclockwise direction in order to draw the disk 41 toward the disk 40 of the pulley 26. By drawing the disk 41 into the disk 40, the effective diameter of the pulley 26 is increased, thereby reducing the drive ratio in the transmission 23 and increasing the speed of the drum 15. When the value of the error signal $V_0$ from the error circuit 121 falls below the reference value $V_2$, the comparitor 117 activates a second switch 133 which delivers a signal from the power source 131 to the servomotor 54. This signal to the servomotor 52 causes the disk 41 of the pulley 26 to move away from the disk 40, thereby reducing the speed of the drum 15.

Figure 5:
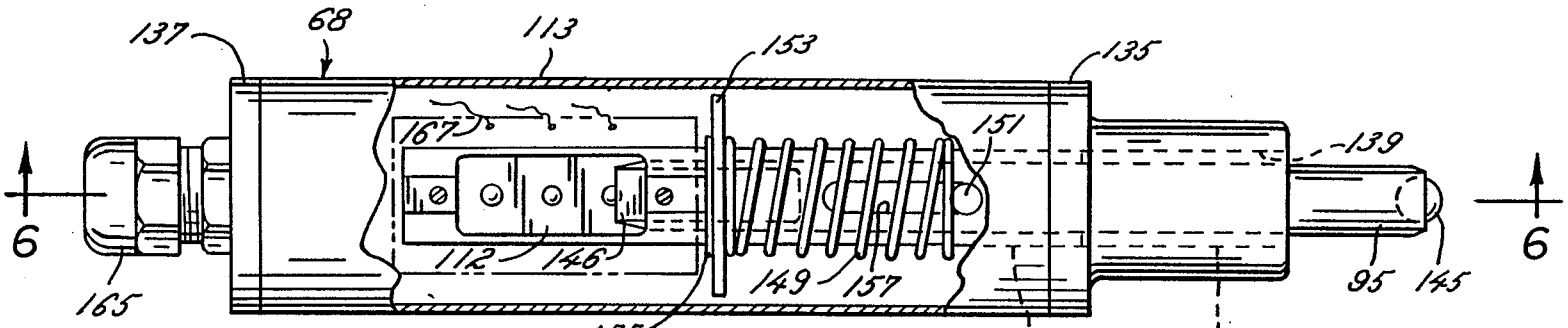
FIG. 5 is an isolated side view of the electromechanical feedback apparatus for converting mechanical motion of the in-line wire drawing machine to an electrical signal, parts of the device being broken away in order to expose an interior construction.
Figure 6:
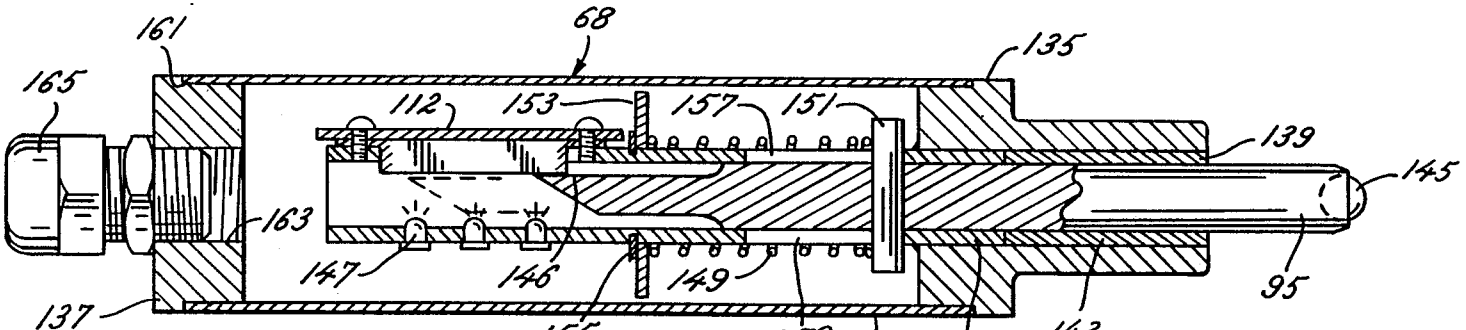
FIG. 6 is a cross-sectional view taken substantially along the line 6—6 of FIG. 5 and showing much of the interior of electro-mechanical device.

Turning to FIGS. 5 and 6, the electromechanical apparatus 68 includes the cylindrical housing 113 for the photoresistor 112 and two end caps 135 and 137 composed of low carbon steel which close the ends of the cylindrical housing so as to effectively seal the photoresistor from the ambient environment. A central bore 139 in the first end cap 135 receives a bushing 141 which extends into the interior of the cylindrical housing 113 and supports the photoresistor 112. The bushing 141 terminates approximately one-third of the distance into the bore 139. A similarly dimensioned cylindrical bearing 143 continues from the point where the bushing 141 terminates to the exterior opening of the bore 139. The cylindrical bearing 143 is preferably made of DURALON TM manufactured by Rexnord Inc. of Milwaukee, Wis.

The plunger 95 is preferably formed from stainless steel and is slidably fitted into the bore 139 lined with the cylindrical bearing 143 and bushing 141. The end of the plunger 95 extending beyond the end cap 135 and contacting the dog 70 is milled to have a concave surface which receives a ball bearing 145. The ball bearing 145 is permanently affixed to the end of the plunger 95 by pressing the bearing into the concave area so as to plastically deform the tip of the plunger, thereby causing the edges of the concave area to come up around the ball bearing and creating a pocket which traps the bearing. The second end of the plunger 95 has a reduced diameter and a wedge-shaped termination 146 intended to block and light emitted from LEDs 147 from reaching portions of the surface area of the photoresistor 112. The photoresistor 112 is preferably a model MPC1055, manufactured by Silicon Sensors, Inc., Dodgeville, Wis. The wedge-shaped taper 146 at the second end of the plunger 95 must be tapered at an angle which avoids casting a shadow on the surface of the photoresistor 112. Furthermore, the surface of the plunger 95 which faces the photoresistor 112 must be spaced sufficiently close to the surface of the photoresistor so as to avoid diffraction of the light into an area of the photoresistor directly under the plunger surface.

The foregoing characteristics of the shape and position of the end of the plunger 95 are required in order to provide a sharp transition between the portion of the photoresistor 112 illuminated by the LEDs 147 and the portion in the shadow of the plunger. The surfaces of the plunger 95 and photoresistor 112 facing one another do not physically touch, thereby providing a virtually frictionless transformation of the mechanical movement of the compensator arm 19 into the oscillatory movement of the plunger 95 which in turn is transformed into an electrical signal for use by the control circuit 97 of FIG. 4.

As the compensator arm 19 pivots, shaft 61 and dog 70 rotate, a coiled spring 149 mounted about the bushing 141 of the electromechanical apparatus 68 biases the plunger 95 outwardly and into engagement with the dog 70. As the compensator arm 19 pivots, the dog 70 acts as a cam surface for translating the pivotal movement of the compensator arm into a linear oscillatory movement of the plunger. As the dog 70 moves clockwise and counterclockwise, the end of the plunger 95 maintains contact with the dog because of the outward bias maintained by the coiled spring 149. To transfer the force of the spring 149 to the plunger 95, the spring is compressed between a dowel pin 151 fitted transversely through the plunger 95 and a washer 153 held in a fixed position about the exterior of the bushing 141 by a snap ring 155. In order to allow the dowel pin 151 to extend transversely beyond the diameter of the plunger 95 and into contact with one end of the compressed spring 149, a pair of diametrically opposing slots 157 and 159 are provided in the bushing 141. These elongated slots 157 and 159 not only allow the dowel pin 151 to contact the spring 149, their ends serve to define the extremes of the oscillatory movement of the plunger 95.

The second end cap 137 of the cylindrical housing 113 is a simple round plug with a stepped section 161 for press fitting into the internal diameter of the cylindrical housing. The end cap 137 includes a threaded bore 163 for receiving a conventional strain relief 165 which sits into the threaded bore and ports wires 167 to the photoresistor 112 and LEDs 147 in a conventional manner.

From the foregoing, it will be appreciated that a novel in-line drawing machine is provided which automatically adjusts for errors between the rates of consumption and feeding of a wire 11 throughout an entire speed range for the drawing machine. Such automatic compensation is accomplished using a relatively inexpensive mechanical variable transmission without introducing troublesome "pull-back" forces. Additionally, the invention utilizes a unique mechanism for converting a mechanical signal to an electrical signal in a virtually frictionless manner using mechanical apparatus with an extremely long life span, thereby resulting in a speed trimming mechanism that has a maintenance-free life span which exceeds virtually any device to which it may be coupled, thereby removing it as a possible source of maintenance problems.

We claim:

1. An apparatus for drawing a length of wire through a die and for supplying the wire to a using station, said apparatus comprising:

a support, a drum rotatably mounted on said support, said drum having an entrance end portion for receiving the wire from the die and having an exit end portion from which the wire is supplied to the using station, there being a coil of wire wrapped around said drum between entrance and exit end portions and said coil being composed of a number of wraps in a single layer, a variable speed drive mechanism for rotating said drum thereby drawing wire onto said entrance end portion and to supply wire off of said exit end portion, said drive mechanism comprising:

a motor, an input pulley connected to be rotated by said motor, an output pulley connected to rotate said drum, and an endless belt connected between said pulleys to transmit rotation from said input pulley to said output pulley, at least one of said pulleys being adjustable in effective diameter and operable when adjusted to change the speed of said output pulley and said drum, a sensing arm mounted for oscillation about a pivot on said support and engaging the wire being supplied from the exit end portion of said drum to said using station in such a manner as to form such wire into a loop, said arm increasing the size of said loop when pivoted in one direction and permitting the size of said loop to decrease when pivoted in the opposite direction, means for biasing said arm in said one direction, and electromechanical means for changing the effective diameter of said at least one pulley and thereby changing the speed of said drum response to pivoting of said arm and without a pull-back force occurring at said arm as a result of said change in diameter.

2. An apparatus as set forth in claim 1 where said electromechanical means includes a slidable shaft mounted in a housing for axial movement in first and second directions in response to clockwise and counterclockwise pivoting, respectively, of said arm for changing the electrical characteristics of a device incorporated into a control circuit operatively coupled to a motor for changing the effective diameter of said at least one pulley.

3. An apparatus as set forth in claim 1 wherein said electromechanical means includes first means for converting the mechanical pivoting of said arm to an electrical signal and second means for returning said electrical signal to a mechanical movement whereby said mechanical movement changes the effective diameter of said at least one pulley.

4. An apparatus as set forth in claim 3 wherein said electromechanical means includes a low-pass filter for removing frequency components of said electrical signal greater than a predetermined value.

5. An apparatus as set forth in claim 2 wherein said electromechanical means produces an electrical signal whose amplitude corresponds to the relative displacement of said arm as it oscillates about its pivot and whose frequency corresponds to the frequency of the oscillations.

6. An apparatus as set forth in claim 5 wherein said electromechanical means includes a filter for effectively removing the relatively high frequency components comprising said electrical signal.

7. An apparatus as set forth in claim 1 wherein said electromechanical means includes first means for representing the rotational speed of said drum as a first value of a predetermined unit of measurement, second means for representing the relative pivotal position of said arm as a second value of a predetermined unit of measurement and third means for determining the difference between said first and second value and adjusting the speed of said drum if said difference is greater than a predetermined amount.

8. An apparatus as set forth in claim 7 wherein said electromechanical means includes a low-pass filter for filtering said second value before said second value is applied to said third means.

9. An apparatus for drawing a length of wire through a die and for supplying the wire to a using station, said apparatus comprising:

a support, a drum rotatably mounted on said support, said drum having an entrance end portion for receiving the wire from the die and having an exit end portion from which the wire is supplied to the using station, there being a coil of wire wrapped around said drum between entrance and exit end portions and said coil being composed of a number of wraps in a single layer, a variable-speed drive mechanisms for rotating said drum thereby drawing wire into said entrance end portion and to supply wire off of said exit end portion, said variable-speed drive mechanism being responsive to the pivoting of a sensing arm pivoted on said support and engaging the wire being supplied from the exit end portion of said drum to said using station in a manner to cause pivoting of said arm when said using station consumes said wire at a speed different from the speed said wire is supplied by said exit portion of said drum, said variable-speed drive mechanism including an electromechanical device for converting the mechanical pivoting of said arm into an electrical signal for use by a control circuit to adjust the speed of said drum in a manner to approximate a supply of said wire at a rate equal to the consumption of said wire by said using station, said electromechanical device comprising, (a) a plunger member mounted for oscillatory movement along its longitudinal axis in response to the oscillatory motion of said sensing arm;

(b) a substantially sealed chamber for receiving a first end of said plunger member and a second end of said plunger member extending from said sealed chamber through a bearing surface to make mechanical contact with said sensing arm;

(c) a sensor mounted within said sealed chamber whose electrical characteristics are sensitive to a change in the position of said second end of said plunger member within said sealed chamber; and (d) means for limiting the extent of said oscillatory movement of said plunger member such that any change in the position of said second end of said plunger member is linearly related to the change in the electrical characteristics affected by the positional change of said second end.

10. An apparatus as set forth in claim 9 wherein the variable-speed drive mechanism includes;

a motor, an input pulley connected to be rotated by the motor, an output pulley connected to rotate the drum and, an endless belt connected between the input and output pulleys to transmit rotation from the input pulley to the output pulley, at least one of the pulleys being adjustable in effective diameter and operable when adjusted to change the speed of the output pulley and the drum, and a second motor forming part of the control circuit responsive to the electrical signal from the electromechanical device for changing the effective diameter of the at least one pulley and thereby changing the speed of the drum in response to pivoting of the arm, without a pull-back force occurring at the arm as a result of the change in diameter.

* * * * *